US007118323B2

(12) United States Patent
Iyer et al.

(10) Patent No.: US 7,118,323 B2
(45) Date of Patent: Oct. 10, 2006

(54) VERTICAL TOWER FAN

(75) Inventors: Vasanthi Iyer, Wilmington, DE (US); Thomas J. Dooley, Springfield, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 77 days.

(21) Appl. No.: 10/977,733

(22) Filed: Oct. 29, 2004

(65) Prior Publication Data

US 2006/0093463 A1 May 4, 2006

(51) Int. Cl.
*F04D 25/10* (2006.01)

(52) U.S. Cl. ..... 415/53.1; 415/224; 416/100

(58) Field of Classification Search ..... 415/53.1, 415/53.2, 53.3, 224; 416/79, 82, 100, 174
See application file for complete search history.

(56) References Cited

U.S. PATENT DOCUMENTS

| | | | | |
|---|---|---|---|---|
| 5,449,271 | A * | 9/1995 | Bushnell et al. | 415/53.1 |
| 5,827,046 | A | 10/1998 | Konno et al. | 416/178 |
| 6,170,275 | B1 * | 1/2001 | Ueno et al. | 416/174 |
| 2005/0123402 | A1 * | 6/2005 | Lim | 416/100 |

FOREIGN PATENT DOCUMENTS

JP 04353293 A * 12/1992

* cited by examiner

*Primary Examiner*—Richard A. Edgar
(74) *Attorney, Agent, or Firm*—Woodcock Washburn LLP

(57) ABSTRACT

A portable, vertical tower fan capable of generating a vertically oriented exhaust air stream that conforms better to a user at an elevation above a support surface. The device includes an vertically elongated housing, an air blower assembly located within the elongated housing and a base provides a space saving design.

66 Claims, 12 Drawing Sheets

VERTICAL TOWER FAN

FIELD OF THE INVENTION

This invention relates to air moving appliances. More specifically, the present invention relates to a vertical tower fan.

BACKGROUND OF THE INVENTION

Portable, free standing fans of various sizes have been used for many years. The normal use of a portable fan is to provide a cooling sensation to the body of the user. This is accomplished by the current of air generated by the fan passing over the skin of an individual. The current of air that passes over an individual serves to increase the convective heat loss of the body through the natural evaporative process of moisture (e.g. sweat) on the skin. The greater the amount of evaporation the greater the sensation of cooling. Further, the greater the portion of the body that can be effected by the current of air the greater the cooling sensation to the user.

Conventional portable fans using axial impellers have been utilized to achieve these desired cooling effects. However conventional axial impeller have several disadvantages. The axial impeller is normally large and requires even larger protective grills. These types of devices not only produce an air stream but may also produce a significant volume of air movement. The shape of the air stream produced by the conventional portable fan utilizing an axial impeller is conical. As the air stream travels away from the fan the area of coverage grows in diameter. The significant volume of air combined with the growth in the coverage area of the air stream may cause objects, (such as papers for example) to be dislodged from their intended place. Further, the volume and growth of the coverage area as described increases the possibility that dust, pollen, dander, etc. will be disturbed and induced to become airborne. Airborne dust and debris can be detrimental to, for example, respiratory conditions.

The volume of air produced by a conventional fan utilizing an axial impeller also requires a predetermined amount of power to produce the volume of air. A greater volume of air requires more power from the electric motor of the fan. More power from the electric motor normally requires that the motor utilize more materials such as lamination steel and copper wire. The increased material usage increases the cost of the conventional fan for both the manufacturer and the end user.

The volume of air produced by a conventional portable fan using an axial impeller also may contribute to increased thrust. Increased thrust is detrimental to the stability of the fan. This thrust must be counteracted by utilizing a large base to stabilize the device. The thrust and stability problem can be exacerbated if the device is elevated above its support surface. The large components (blades and protective grills) of axial fans along with the increased thrust and corresponding stability problems do not allow these types of devices to be easily transportable (portable) or to have space saving characteristics.

The large base and grills of the conventional portable fan, as described, require a significant amount of packaging material as well as space for shipment. In an effort to conserve space requirements for shipping these fans are often disassembled and require customer assembly. If the customer fails to follow the assembly instructions properly the fan may not be stable, safe and/or may be returned to the manufacturer. This may causes extra cost for the manufacturer, retailer and be the cause of a poor customer experience.

SUMMARY OF THE INVENTION

In view of the deficiencies of the prior art the following description is of a vertical tower fan that overcomes several if not all of the prior art deficiencies.

According to one aspect of the invention, the device is portable and includes an air blower assembly, and a vertically oriented elongate housing having a longitudinal length extending substantially upward from a support surface.

According to another aspect of the invention, the elongate housing defines an interior space having an air blower assembly disposed within.

According to another aspect of the invention, the air blower assembly includes at least one motor, and at least one air impeller rotated about a vertical axis of rotation by the motor.

According to yet another aspect of the invention, the housing includes at least one air inlet allowing intake air to enter the interior space and an elongate air outlet allowing an exhaust air stream generated by the air blower assembly to exit the interior space of the housing.

According to another aspect of the invention, the device includes an air guide within the interior space. The air guide is positioned within the interior space to extend along the axial length of the air impeller.

According to another aspect of the invention, the device includes an air cut-off within the interior space. The air guide is positioned within the interior space to extend along the axial length of the air impeller.

According to another aspect of the invention, the device includes a base for engaging the support surface.

According to yet another aspect of the invention, the air impeller has an axial length greater than about 24 inches;

According to another aspect of the invention, the overall height of the device, defined as the distance from where the base engages the support surface to a maximum vertical extent of the device is greater than about 44 inches.

According to another aspect of the invention, the air impeller is a transverse type air impeller.

According to another aspect of the invention, the air guide includes a concave form when referenced from the axis of rotation of the air impeller and the air cut-off includes a convex form when referenced from the axis of rotation of the air impeller.

According to another aspect of the invention, the interior space includes an intake portion in fluid communication with the air inlet and defined by portions of the elongate housing, the air guide, the air cut-off, and the air impeller.

According to yet another aspect of the invention, the interior space includes an exhaust portion in fluid communication with the elongate air outlet and defined by portions of the air guide, the air cut-off, and the air impeller.

According to another aspect of the invention, the elongate housing includes a vertical aspect ratio greater than about 3 to 1 defined by the longitudinal length being greater than a maximum width of the elongate housing.

According to another aspect of the invention, the device includes a maximum exit elevation of the exhaust air stream greater than about 36 inches and a minimum exit elevation of the exhaust air stream less than about 15 inches. The maximum exit elevation is defined by a distance from the support surface to the highest vertical exit elevation of the exhaust air stream. The minimum exit elevation is defined by the distance from the support surface to the lowest vertical exit elevation of the exhaust air stream.

According to another aspect of the invention, the vertical length of the exhaust air stream as it exits the housing is greater than about 24 inches.

According to another aspect of the invention, the air impeller includes a maximum diameter of less than about 4 inches.

According to another aspect of the invention, the air impeller is constructed of fiber-reinforced polymer utilizing a polymer matrix and fibers and/or filaments.

According to another aspect of the invention, the air impeller is located substantially above the motor with respect to the base and an upper impeller bearing assembly supports an impeller shaft as the air impeller rotates about it's vertical axis of rotation.

According to another aspect of the invention, the impeller bearing assembly includes a spherical bearing. Preferably, the spherical bearing is constructed of porous material and includes an oil cup, capillary media physically contacting the spherical bearing and substantially covering the inside circumferential area of the oil cup, oil, and a slinger that rotates in conjunction with the air impeller.

According to another aspect of the invention, the oil cup extends below the spherical bearing toward the support surface allowing the capillary media to return the oil to the bearing after the oil migrates along the impeller shaft toward the oil slinger.

Additional features of the present invention are set forth below.

BRIEF DESCRIPTION OF THE DRAWINGS

The invention is best understood from the following detailed description when read in connection with the accompanying drawing. It is emphasized that, according to common practice, various features of the drawings are not to scale. On the contrary, the dimensions of various features are arbitrarily expanded or reduced for clarity. Included in the drawings are the following Figures.

DETAILED DESCRIPTION OF ILLUSTRATIVE EMBODIMENTS

The present invention is directed to a vertical tower fan that includes a vertical aspect ratio relative to a support surface. The air stream produced by the device also has a vertical aspect ratio. The vertical aspect ratio of the device and air stream allow the generated air stream to better conform to the human form without the need to produce large volumes of air.

The lower volume of air generated by the device has a velocity sufficient to impinge upon the user, which accelerates evaporation and the cooling effect on the user. The lower volume of air also requires less power to produce, thus reducing the cost of the electric motor within the device. The lower volume of air produced also lowers the thrust and increases the stability of the device. The increased stability of the device reduces the requirement for a large base.

The device is also able to more precisely direct the generated air stream at the user than the prior art, which also accelerates evaporation and the cooling effect on the user. A more precise direction of the generated air stream also reduces the possibility that object, dust, pollen, dander, etc. will be disturbed.

The vertical tower fan also offers a space saving design over conventional fans. The use of a transverse impeller, (cross flow blower) eliminates the need for large protective grills typically required on, for example, axial type fans. The decreased base size, resulting from the reduced thrust, as well as the elimination of the large protective grills minimize the space required to operate, store and ship the device. The minimization of space significantly enhances the space saving aspects of the device. The minimization of space may also allow the device to be shipped with little or no customer assembly. Little or no customer assembly increases customer satisfaction and may decrease returns to the retailer and manufacturer.

The present invention includes various combinations of one or more of the above characteristics and features at a desirable retail cost for the consumer.

Figure 1:
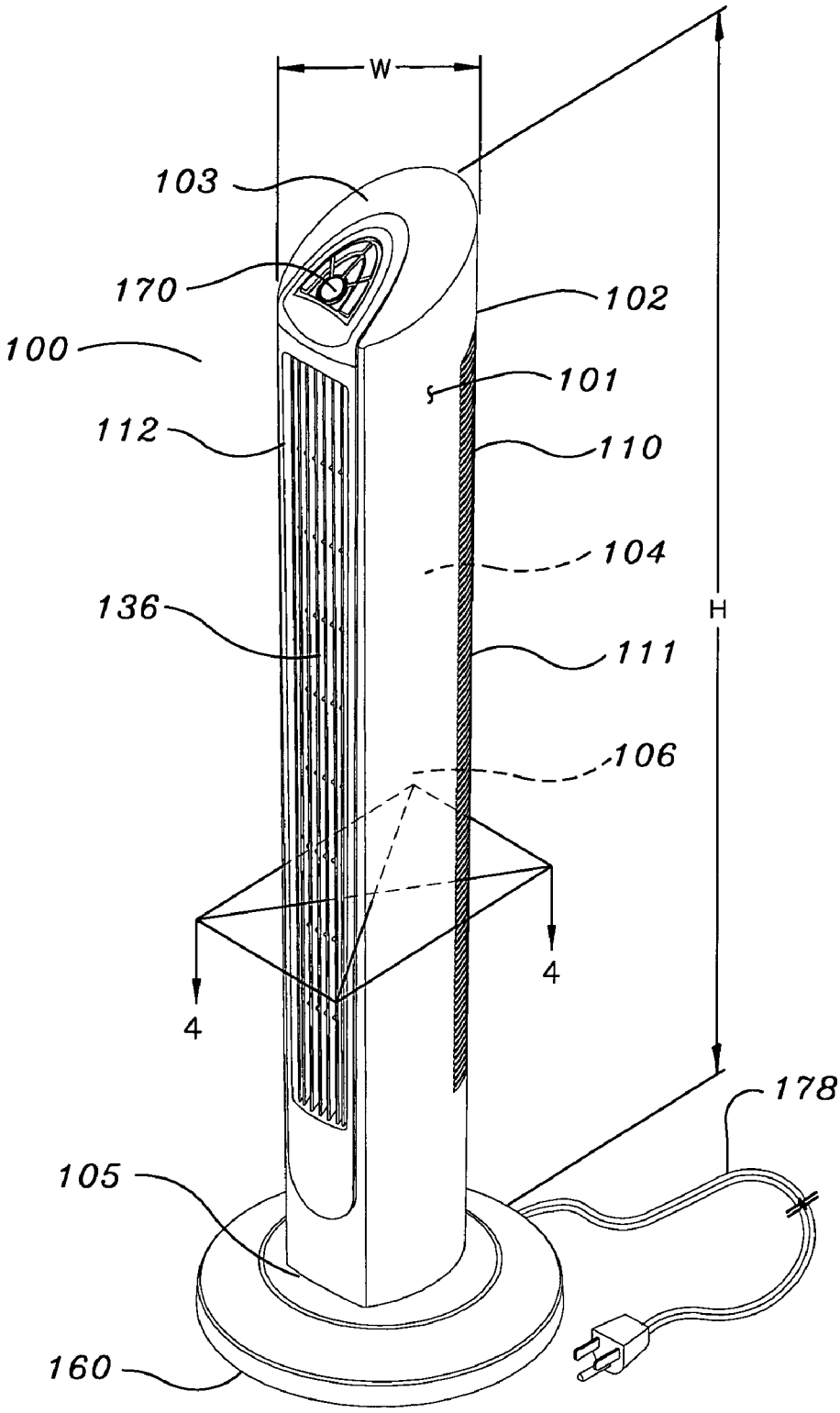
FIG. 1 is a perspective view of an exemplary embodiment of a vertical tower fan in accordance with the present invention.

FIG. 1 is a perspective view of an exemplary vertical tower fan 100. As shown in FIG. 1, vertical tower fan 100 includes housing 102 having at least one side wall 101 extending between top 103 and lower end 105. As shown, vertical tower fan 100 includes base 160 for engaging a support surface (not shown). Housing 102 includes interior space 104. Disposed within interior space 104 is air blower assembly 106.

In one exemplary embodiment, housing 102 is an elongate housing having a vertical aspect ratio. The vertical aspect ratio of housing 102 is defined as the vertical height H of housing 102 being greater than a maximum horizontal width W of housing 102. In one embodiment the vertical aspect ratio of said elongate housing is greater than about 3 to 1.

Vertical tower fan 100 includes at least one air inlet 110 and at least one air outlet 112. As shown in FIG. 1, air inlet 110 is preferably located on a rear portion of housing 102 and air outlet 112 is located in a front portion of housing 102. Preferably air inlet grill 111 is provided over air inlet 110 and air outlet grill 136 is provided over air outlet 112. Outlet grill 136 may include louvers that are positional for directing a flow of exhaust air exiting air outlet 112.

Vertical tower fan 100 also includes at least one control assembly 170. Control assembly 170 controls a function of vertical tower fan 100. Also shown is power cord 178, utilized to connect vertical tower fan 100 to an electrical power source (i.e. wall outlet). The electrical component connections of vertical tower fan 100 are integrated within the device, such as for example between control assembly 170 and blower assembly 106. The integration of the electrical component connections within the device eliminates the need for the user to make such connections. In the exemplary embodiment shown, for example, only the connection of power cord 178 to an electrical power source is required for operation of the device. The integration of all the electrical component connections within the device also enhance the portability of vertical tower fan 100.

Figure 2:
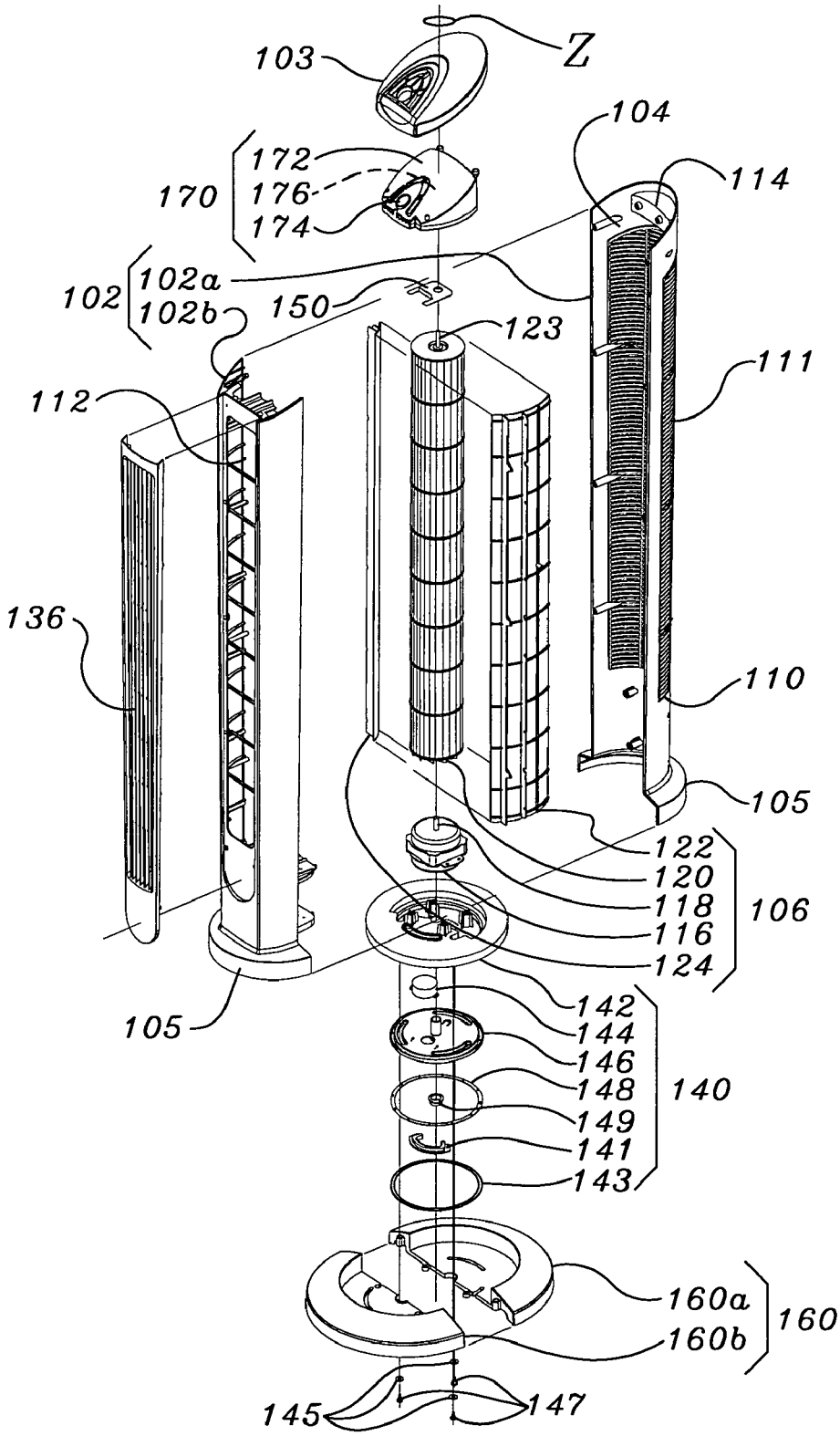
FIG. 2 is an exploded view of the exemplary embodiment of FIG. 1.

FIG. 2 is an exploded perspective view of vertical tower fan 100. As shown in FIG. 2, housing 102 may be constructed of more than one component, such as, for example, two body halves 102*a* and 102*b* that are assembled together. Housing 102 has at least one air inlet 110 and one air outlet 112. Housing 102 defines interior space 104.

As shown, housing 102 also includes handle 114. Handle 114 is used to increase the convenience of portability of the device. It is contemplated that handle 114 may be an integral part of housing 102 as shown, or alternatively, handle 114 may be formed as a separate piece or pieces (not shown) that are attached to vertical tower fan 100.

Disposed within interior space 104 is air blower assembly 106. Air blower assembly 106 includes motor 116 and at least one air impeller 120 connected to motor shaft 118. Motor 116 rotates air impeller 120 about axis of rotation Z. Motor 116 may be mounted to housing 102 via a bracket (not shown) or through other conventional means. In a preferred embodiment air impeller 120 is a transverse type impeller. As shown in FIG. 2 motor 116 is preferably located below air impeller 120, thus allowing the mass of motor 116 to be located low with respect to a support surface. The low location of the mass of motor 116 lowers the center of gravity and hence increases the overall stability of vertical tower fan 100.

Figure 4:
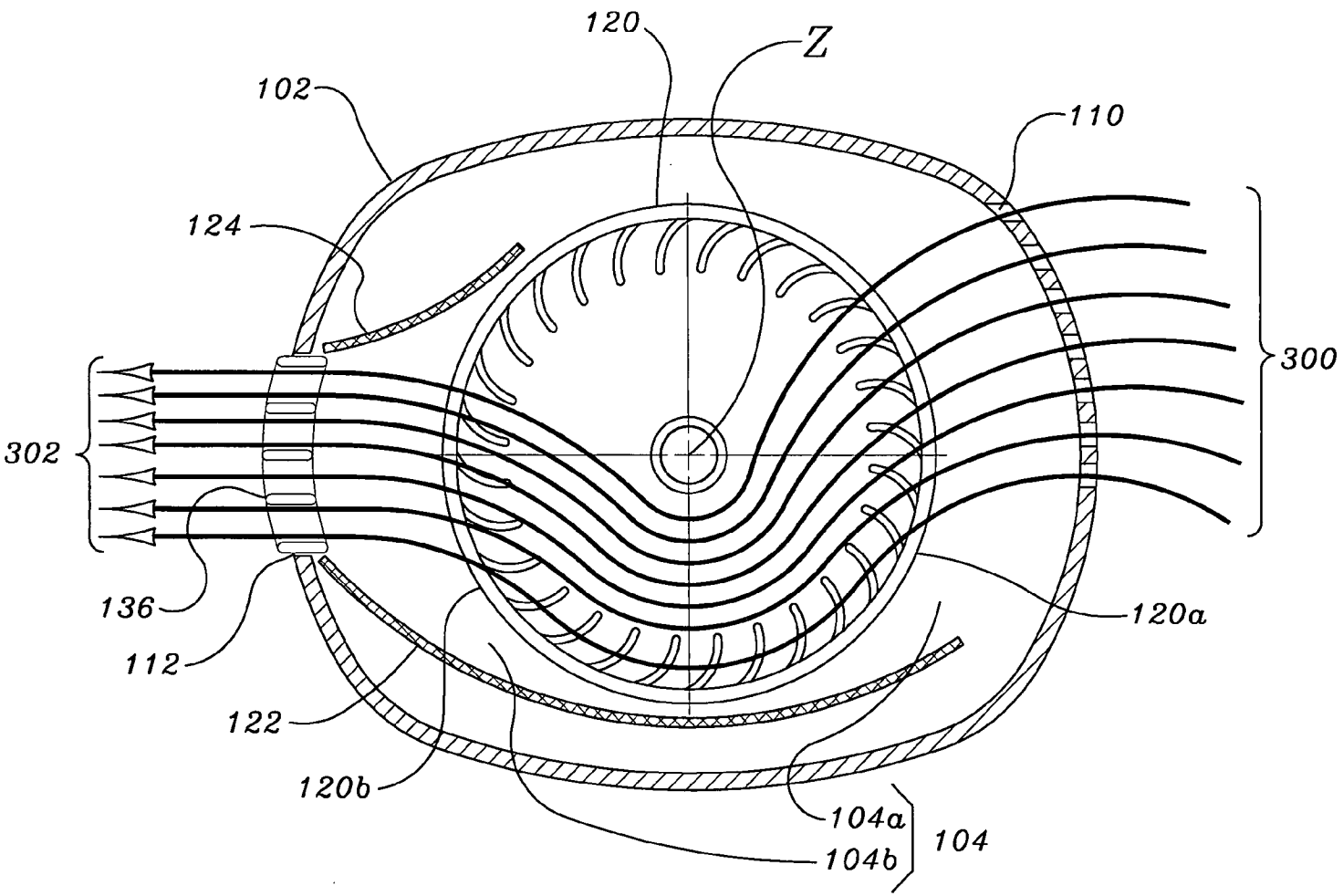
FIG. 4 is a sectional view taken along horizontal section plane 4—4 of FIG. 1 illustrating the air flow pattern into, through, and exiting the exemplary vertical tower fan.

Also shown in FIGS. 2 and 4 are air guide 122 and air cut-off 124. Preferably, the shape and form of air guide 122 when referenced from axis of rotation Z of air impeller 120 is concave and extends substantially the entire axial length of air impeller 120. Preferably, the shape and form of air cut-off 124 when referenced from axis of rotation Z of air impeller 120 is convex and extends substantially the entire axial length of air impeller 120.

In the exemplary embodiment shown, air guide 122 and air cut-off 124 are discrete parts. It is contemplated that one or both air guide 122 and/or air cut-off 124 could be designed so as to be integral with another component of vertical tower fan 100, such as, for example, housing 102. It should be noted that the use of air guide 122 and air cut-off 124 as discrete parts may allow better control of form and shape of these components and thus increase the possible efficiency of blower assembly 106.

Also shown in FIG. 2 are impeller shaft 123 and upper impeller bearing assembly 150. Upper impeller bearing assembly 150 supports impeller shaft 123 of air impeller 120 as it rotates about axis of rotation Z.

Preferably, protective grill 136 is located proximate air outlet 112. Protective grill 136 is designed to protect interior space 104 from the penetration of foreign objects. Protective grill 136 is also designed to minimize it's impedance to exhaust air stream exiting vertical tower fan 100. Incorporated with protective grill 136 may be air directing devices, such as, for example, adjustable louvers (not shown). Adjustable louvers allow additional directional control capabilities of the high velocity air stream. Protective grill 136 may be attached to housing 102 through an assembly device, (not shown), such as for example; screws, adhesives or snaps.

Intake grills 111 is preferably located proximate at least one air inlet 110. Intake grills 111 is designed to minimize their impedance to the flow of air into vertical tower fan 100 while at the same time protecting vertical tower fan 100 from the penetration of foreign objects into interior space 104. As shown, intake grill 111 may be an integral part of housing 102, specifically body half 102*a*.

Although the exemplary embodiment shown in FIG. 2 illustrates base 160 and housing 102 as separate pieces, the invention is not so limited. It is contemplated that the support of housing 102 may be accomplished in a variety of ways, such as forming base 160 as a unitary member having a variety of predetermined shapes. As shown, base 160 may further disassemble into multiple parts, for example base portion 160*a* and base portion 160*b*.

In one exemplary embodiment, housing 102 rotates with respect to base 160 and/or a support surface (not shown). Such rotation may be accomplished either in an oscillatory fashion, a stepwise positioning of housing 102 (either manually or under automated control), or in a constant rotation, either in a clockwise or counter-clockwise direction. In one example the rotational range of housing 102 is between about 0 degrees and about 360 degrees. In another exemplary embodiment the rotational range is between about 0 degrees and about 90 degrees.

FIG. 2 also shows oscillating mechanism 140. Oscillating mechanism 140 moves housing 102 of portable air moving device 100 through an oscillation movement. The oscillation movement allows the generated air stream to be dispersed over a larger area if desired. As shown, oscillating mechanism 140 includes oscillation plate 142, oscillation motor 144, motor plate 146, upper thrust bearing 148, radial bearing 149, gear 141 and lower thrust bearing 143. Oscillation mechanism 140 is assembled together using conventional methods for example, washers 145 and oscillation shoulder screws 147. It is contemplated that other oscillating mechanisms, such as a link and pivot design, may be used to achieve oscillation movement.

Control assembly 170 is used to control a function of vertical tower fan 100, such as, for example, the speed of air blower assembly 106 and/or rotation or oscillation of housing 102. As shown control assembly may include control cover 172, button plate 174 and electronic components 176. In a preferred embodiment, electronic components 176 are located within control cover 172. Electronic components 176 may include, for example, switches, power control boards and LED indicators. In one preferred embodiment control assembly 170 is mounted on top 103 housing 102. The position of control assembly 170 on the substantially vertical and upright structure of vertical tower fan 100 benefits the user in that the height of control assembly 170 above a support surface (floor) allows convenient accessibility for visual inspection and manual adjustment of the controlled functions. Alternatively, remote control unit 171 (shown in FIG. 5) may accomplish the control of vertical tower fan 100 in conjunction with, and/or as a replacement for control assembly 170.

It is contemplated that vertical tower fan 100 may be constructed with material such as polymers, sealed motors, sealed switches and other components, such as for example rain sensor 181 (shown in FIG. 5) that could optimize a weather proof construction. This would facilitate the use of vertical tower fan 100 on decks, boats and other areas that might be exposed to varying weather conditions.

Figure 3:
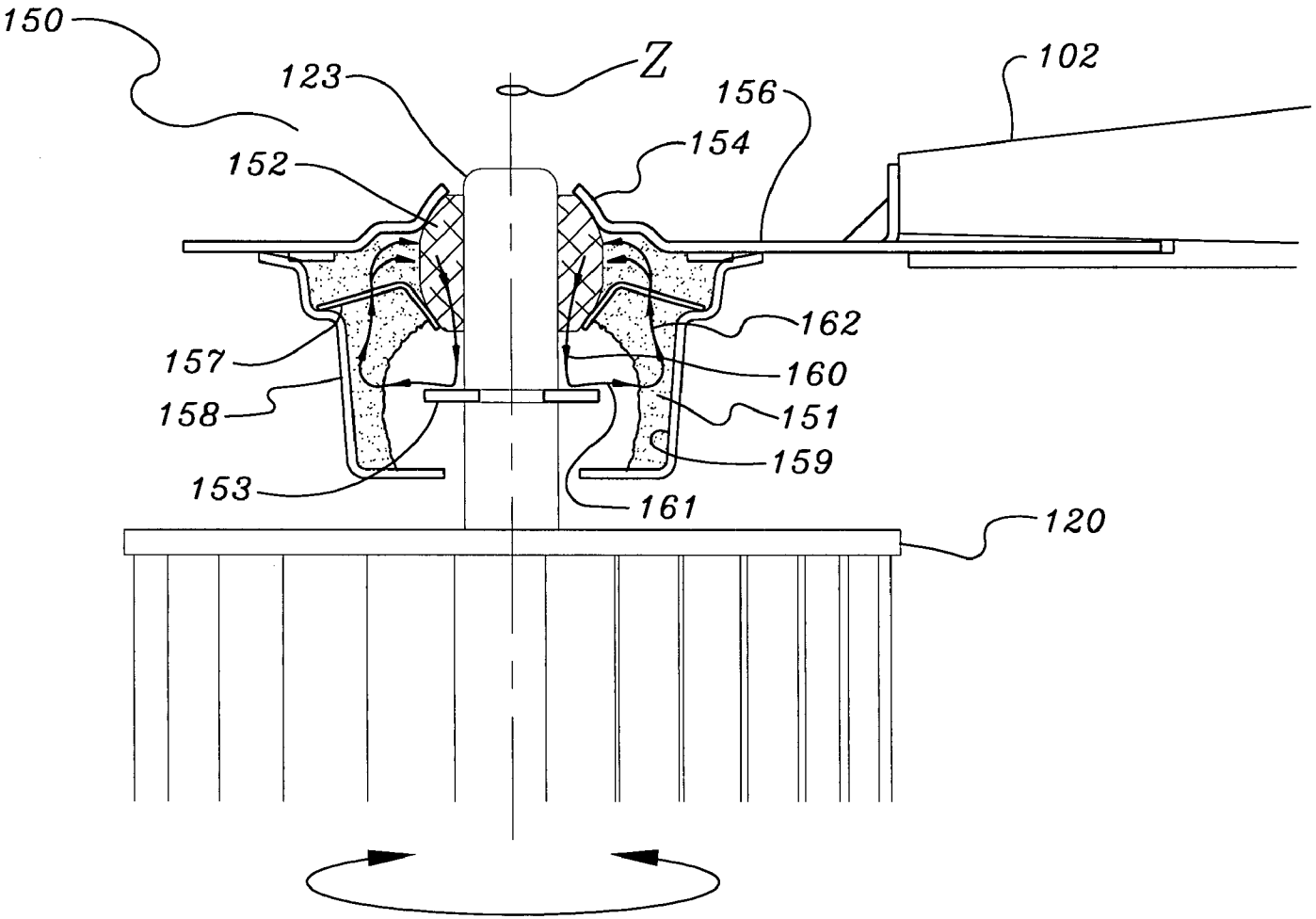
FIG. 3 is a detailed sectional view of an exemplary upper impeller bearing of the present invention.

FIG. 3 is a detailed sectional view of upper impeller bearing assembly 150 of vertical tower fan 100. As shown, shaft 123 of air impeller 120 is located within bearing 152 of upper impeller bearing assembly 150. Bearing 152 may be a spherical bearing and composed of an oil impregnated porous material, such as, for example, sintered metal. In this example, bearing 152 is located in socket area 154 of bracket 156 and held into position via retention spring 157 and oil cup 158. Bracket 156, in this example, is attached to housing 102 of vertical tower fan 100. Retention spring 157 is designed to hold bearing 152 in place while yet allowing bearing 152 to rotate within socket area 154. The rotation of bearing 152 within socket area 154 allows the internal diameter of bearing 152 to "self align" with axis of rotation Z of shaft 123 of air impeller 120. As shown, oil saturated capillary media 151 is located around and contacting bearing 152 and along the interior circumferential sides 159 of oil cup 158. Oil saturated capillary media 151 may be an organic material such as for example, wood pulp. Oil slinger 153 is assembled to shaft 123.

Functionally, as shaft 123 rotates about axis Z causing a hydrodynamic oil film to develop between shaft 123 and the internal diameter of bearing 152. Gravity will naturally cause the oil film to migrate down the shaft along a first path 160. Oil contacts oil slinger 153 that is rotating with shaft 123. Centrifugal force is imparted to the oil film and causes the oil film to be "slung" radially out along second path 161. Oil film is then absorbed into capillary media 151 and moves via capillary action along path 162 making contact with bearing 152. The oil film is then absorbed into bearing 152 and recirculates through the hydrodynamic process again.

The use of bearing assembly 150 as described increases the life of bearing 152 and shaft 123, increasing in turn the overall functional life of vertical tower fan 100. If the oil film is allowed to dissipate from bearing 152 without recirculation as described, the friction between shaft 123 and bearing 152 will cause pre-mature failure.

FIG. 4 is the section cut by horizontal section plane 4—4 as shown in FIG. 1. FIG. 4 shows the air flow into and out of interior space 104 of housing 102. The rotation of air impeller 120 about axis of rotation Z induces intake air 300 into interior space 104 of housing 102 through at least one air inlet 110. Intake air 300 enters air impeller 120 and is accelerated and propelled by air impeller 120 and exits housing 102 through air outlet 112 as exhaust air stream 302. As shown, air impeller 120 may be a transverse type impeller.

Preferably air guide 122 and air cut off 124 segregate interior space 104 of housing 102 into intake portion 104*a* and exhaust portion 104*b*. The position of air guide 122 and air cut off 124 relative to air impeller 120 allow the free rotation of air impeller 120 around axis Z while simultaneously preventing the recirculation of exhaust air 302 from exhaust portion 104*b* toward intake portion 104*a* within interior space 104. The impedance of air recirculation within interior space 104 encourages a more efficient movement of intake air 300 and exhaust air stream 302 through vertical tower fan 100. Air guide 122, in this example, is concave when referenced from axis of rotation Z of air impeller 120. Air cut-off 124, in this example, is convex when referenced from axis of rotation Z of air impeller 120.

The shape and form of both air guide 122 and air cut-off 124 allow a rotation of air impeller 120 about axis of rotation Z to efficiently develop a first pressure differential between intake portion 104*a* and the atmosphere exterior to housing 102. This first pressure differential induces intake air 300 to enter intake portion 104*a* through air inlet 110. The shape and form of both air guide 122 and air cut-off 124 also allow a rotation of air impeller 120 about axis of rotation Z to efficiently develop a second pressure differential between exhaust portion 104*b* and the atmosphere exterior to housing 102. This second pressure differential induces exhaust air stream 302 to exit exhaust portion 104*b* through air outlet 112.

Air guide 122 and air cut off 124 divide air impeller 120 into intake side 120*a* and exhaust side 120*b*. Intake side 120*a* is defined as a first distance measured in a direction of rotation of air impeller 120 along the circumference of air impeller 120 from air cut off 124 to air guide 122. Exhaust side 120*b* is defined as a second distance measured in a direction of rotation of air impeller 120 along the circumference of air impeller 120 from air guide 122 to air cut off 124. Intake side 120*a* of air impeller 120 is in direct fluid communication with air inlet 110 via intake portion 104*a* of interior space 104. In a like manner exhaust side 120*b* of air impeller 120 is in direct fluid communication with air outlet 112 via exhaust portion 104*b* of interior space 104.

Located proximate air outlet 112 is protective grill 136. Protective grill 136 is designed to minimize it's impedance to exhaust air stream 302 as it exits housing 102, while yet protecting air impeller 120 from the penetration of foreign objects.

Figure 6:
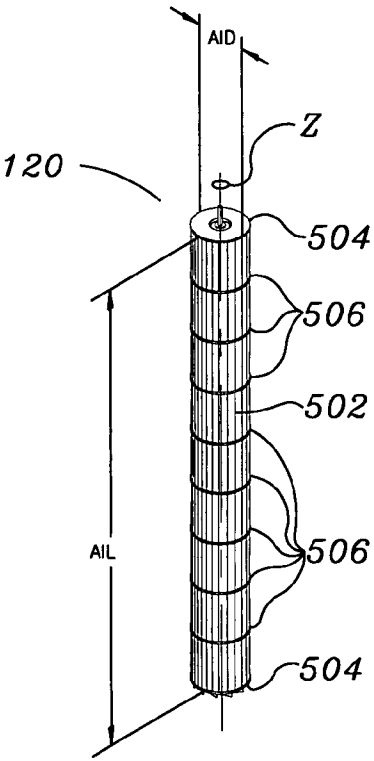
FIGS. 5 and 6 illustrates various dimensional aspects of the physical structure and the air flow pattern generated by one embodiment of the present invention.
Figure 5:
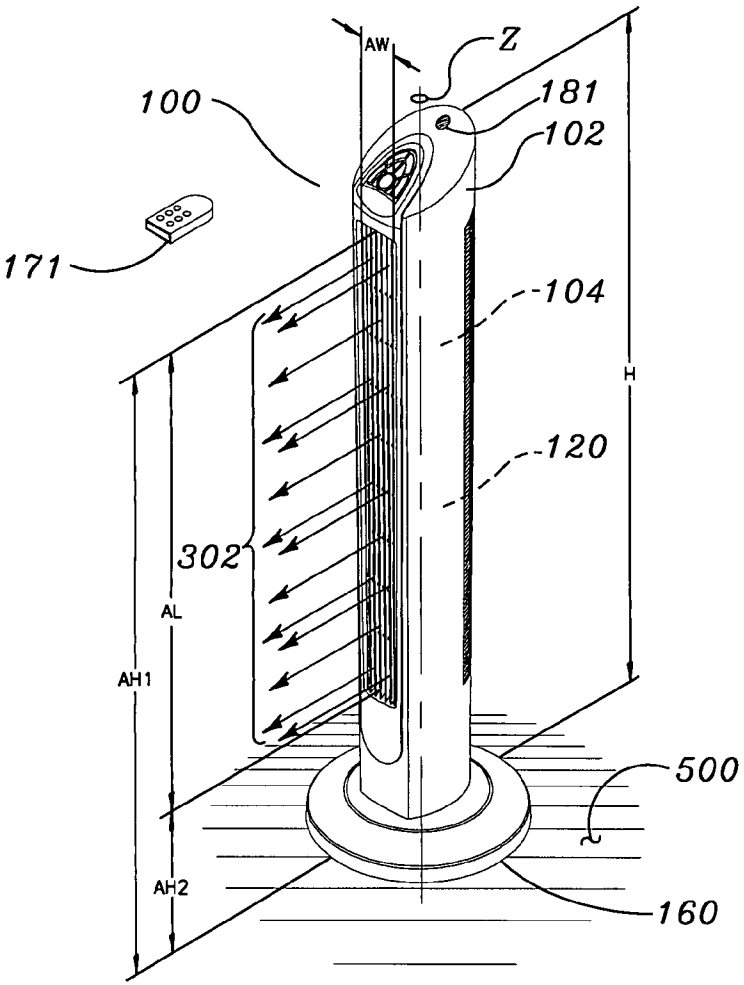

FIGS. 5 and 6 illustrate various dimensional aspects and the air flow pattern of the exhaust air stream generated by an embodiment of vertical tower fan 100. FIG. 5 shows the overall height, dimension H of vertical tower fan 100. Dimension H is defined by the distance from the bottom of base 160 (i.e., where the base 160 contacts support surface 500) to the highest vertical extent of housing 102.

Also shown in FIG. 5 are various dimensions for exhaust air stream 302. Dimension AH1 is the maximum exit elevation of exhaust air stream 302. Dimension AH1 is defined by the distance from the bottom of base 160 (support surface 500) to the highest vertical exit elevation of exhaust air stream 302 as it exits housing 102. Dimension AH2 is the minimum exit elevation of exhaust air stream 302. Dimension AH2 is defined by the distance from the bottom of base 160 (support surface 500) to the lowest vertical exit elevation of exhaust air stream 302 from housing 102. Dimension AL is the vertical length (i.e., height) of exhaust air stream 302. Dimension AL is defined by the distance between the highest vertical exit elevation of exhaust air stream 302 to the lowest vertical exit elevation of exhaust air stream 302. Dimension AW is a maximum width of exhaust air stream 302. Dimension AW is defined by a maximum horizontal width of exhaust air stream 302 as it exits from housing 102.

FIG. 6 show dimension aspects of air impeller 120 located within interior space 104 of housing 102 of vertical tower fan 100. As shown, air impeller 120 may be a transverse type impeller. Shown in FIG. 6 are dimensions AID and AIL. Dimension AID is defined as the maximum diameter of air impeller 120 corresponding to impeller fins 502, impeller ends 504 and/or fin support structures 506. Dimension AIL is defined as the maximum axial length (i.e., height) corresponding to the portion of air impeller 120 that produces exhaust air stream 302.

In one embodiment, dimension H is greater than about 44 inches, dimension AH1 is greater than about 36 inches and dimension AH2 is less than about 15 inches. In one preferred embodiment, exhaust air stream 302 has an elongate vertical aspect ratio. The elongate vertical aspect ratio of exhaust air stream 302 is defined as dimension AL being greater than dimension AW. In one embodiment, Dimension AL of exhaust air stream 302 is greater than about 24 inches. In one embodiment the vertical aspect ratio of exhaust air stream 302 is about 10 to 1 or greater.

As described and shown, the dimensional aspects of vertical tower fan 100 combined with the dimensional aspects of exhaust air stream 302 and air impeller 120 allow the generated exhaust air stream 302 to better conform to the elongated form of the human body. The dimensional aspects of air exhaust air stream 302 and air impeller 120 have been designed to effectively generate exhaust air stream 302 with an ability to reach the user at a predetermined distance from vertical tower fan 100 at a predetermined velocity thus delivering the desired cooling effect. The air flow characteristics of exhaust air stream 302 may be stated:

$$Q/A=V$$

Where: Q is the volume (cubic feet per minute) of air generated by air impeller 120. V is the desired velocity (feet per minute) of exhaust air stream 302. A is the area of exhaust air stream 302 as it exits housing 102. area A can also be expressed:

$$A=AL\times AW$$

The air flow characteristics of exhaust air stream 302 therefore may be stated:

$$Q/(AL\times AW)=V$$

The dimensional aspects of vertical tower fan 100 consider the following: The velocity V of air stream 302 is predetermined to effectively reach the user and deliver the desired cooling effect. The desired volume of air flow Q generated by air impeller 120 is also predetermined in that Q is limited to allow the use of a low power electric motor. A lower Q requires less power to produce than a higher Q. AL is also predetermined to sufficiently conform to the desired elongate form of the human body. Therefore AW remains to be manipulated to achieve the predetermined velocity characteristics V of exhaust air stream 302. In one embodiment AW of exhaust air stream 302 is about 3 inches or less.

The volume of air Q generated by air impeller 120 is influenced by dimensions AID of air impeller 120 and dimension AIL of air impeller 120. Dimension AIL of air impeller 120 is predetermined to conform to the desired elongate form of exhaust air stream 302. Therefore, an effective way to limit air volume Q of impeller 120 is to reduce dimension AID. One advantage of a reduced dimension AID of air impeller 120 is that it more easily fits within elongated housing 102 of vertical tower fan 100, thus maintaining the desired vertical aspect ratio. Another advantage of the reduced dimension AID of air impeller 120 is that any uneven weight distribution within the structure of air impeller 120 is less likely to effect the rotation of air impeller 120, thus reducing possible vibrations due to impeller imbalance. In one embodiment dimension AIL of air impeller 120 is greater than about 24 inches. In one embodiment dimension AID of air impeller 120 is less than about 4 inches. In another embodiment dimension AID of air impeller 120 is within a range between about 2.5 inches and about 3.75 inches.

The desired length AIL of air impeller 120 increases the possibility of distortion and force balance problems in the structure of air impeller 120. The structural problems may occur in the fabrication or assembly of air impeller 120. The desired length AIL of air impeller 120 also increases the distance between bearing support areas (not shown) at the opposite extents of length AIL. Increased distance between bearing support areas augment the possibility of vibration and dynamic imbalances during the rotation of air impeller 120. The possible structural distortion of air impeller 120 will further contribute to vibration and dynamic imbalances during the rotation of air impeller 120.

One manner to mitigate the possible structural distortion is to construct air impeller 120 of a fiber-reinforced polymer utilizing a polymer matrix, such as, for example, acrylonitrile-butadiene-styrene (ABS) and fibers, filaments and/or fillers, such as, for example; glass, ceramic, textile and/or steel. The use of such a material increases the structural strength and dimensional stability of air impeller 120. The increased strength and dimensional stability of air impeller 120 further enhance the balance and precision of air impeller 120 during the operation of vertical tower fan 100 thus maintaining better designed performance characteristics.

Another manner to obtain the balance and structure desired is to construct air impeller 120 from multiple sections of impeller fins 502, impeller ends 504 and support structures 506. The multiple sections of air impeller 120 may be assembled together utilizing conventional assembly techniques, such as, for example: adhesives, chemical reactive welding, ultrasonic welding, etc. The use of multiple sections decrease the size of a the molded parts enhancing the ability of a fiber-reinforced polymer to fill the tool cavity during the injection molding process. The use of multiple sections also adds support structures 506 throughout the length AIL of air impeller 120. The distribution of support structures 506 throughout the length AIL of air impeller 120 increases the structural strength and dimensional stability of air impeller 120. In one embodiment air impeller 120 includes about 6 or more sections of impeller fins 502. In another embodiment air impeller 120 is constructed of between about 7 and about 12 sections of impeller fins 502. In another embodiment the axial length of one section of impeller fins 502 is less than about 5 inches. In yet another embodiment the axial length of one section of impeller fins 502 is between 2.5 inches and about 4.5 inches.

An impeller with the aforementioned material, size and structure characteristics minimizes unwanted vibration and dynamic imbalances during a rotation of air impeller 120. In turn minimizing the need for extensive dynamic or static balancing of impeller 120. If limited balancing is needed, it has been found that the balance of air impeller 120 is improved if the rotational speed (RPM) of air impeller 120 during a dynamic balancing process is substantially equal to the maximum operational rotational speed of air impeller 120. The maximum operational rotational speed of air impeller 120 is defined as the maximum rotational speed which air impeller 120 will experience within the normal operational parameters of vertical tower fan 100.

Figure 7:
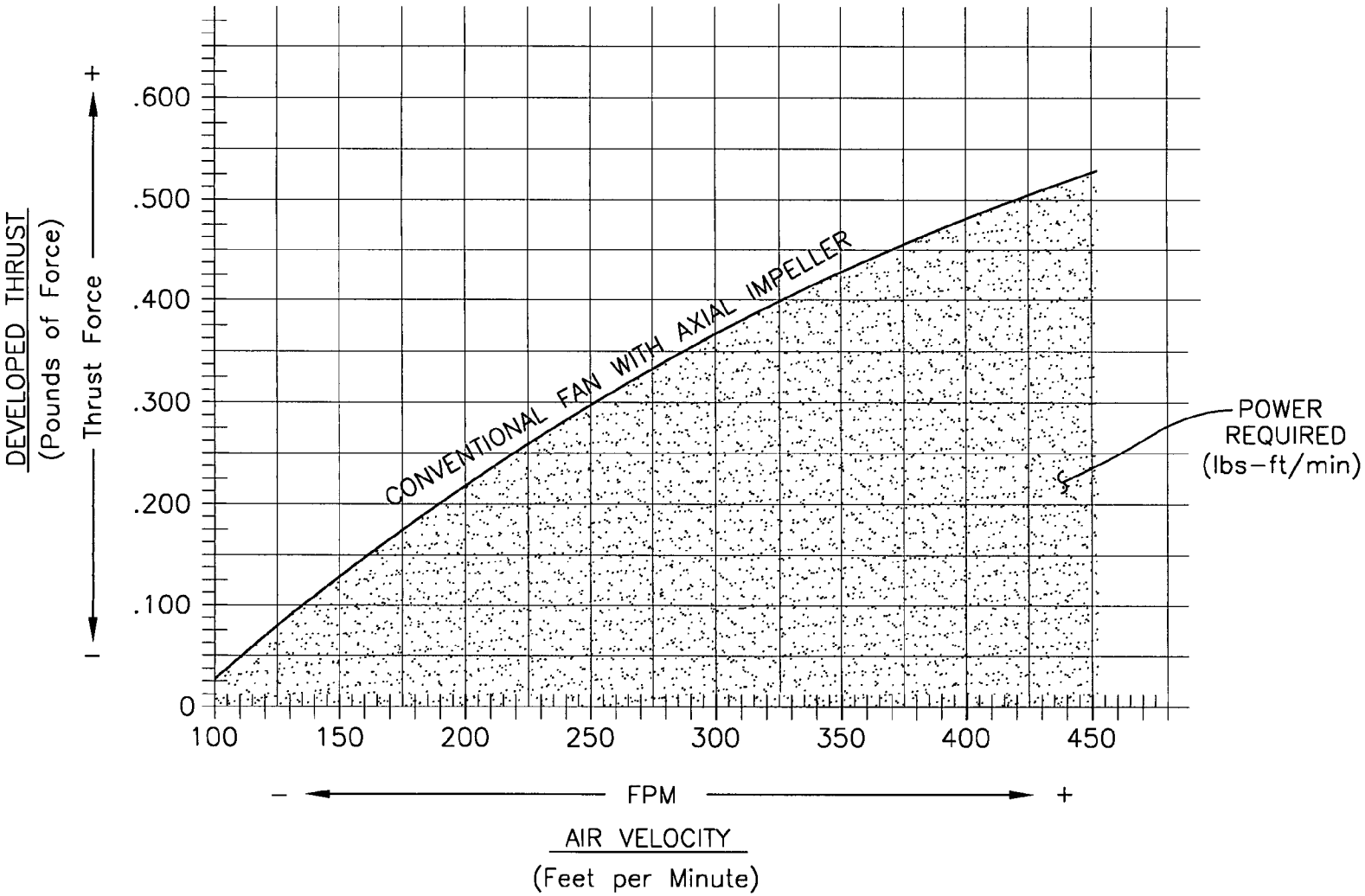
FIG. 7 PRIOR ART
FIGS. 7 and 8 are graphs that compare the thrust characteristic of a conventional portable fan utilizing an axial impeller and an embodiment of the vertical tower fan in accordance with the present invention.
Figure 8:
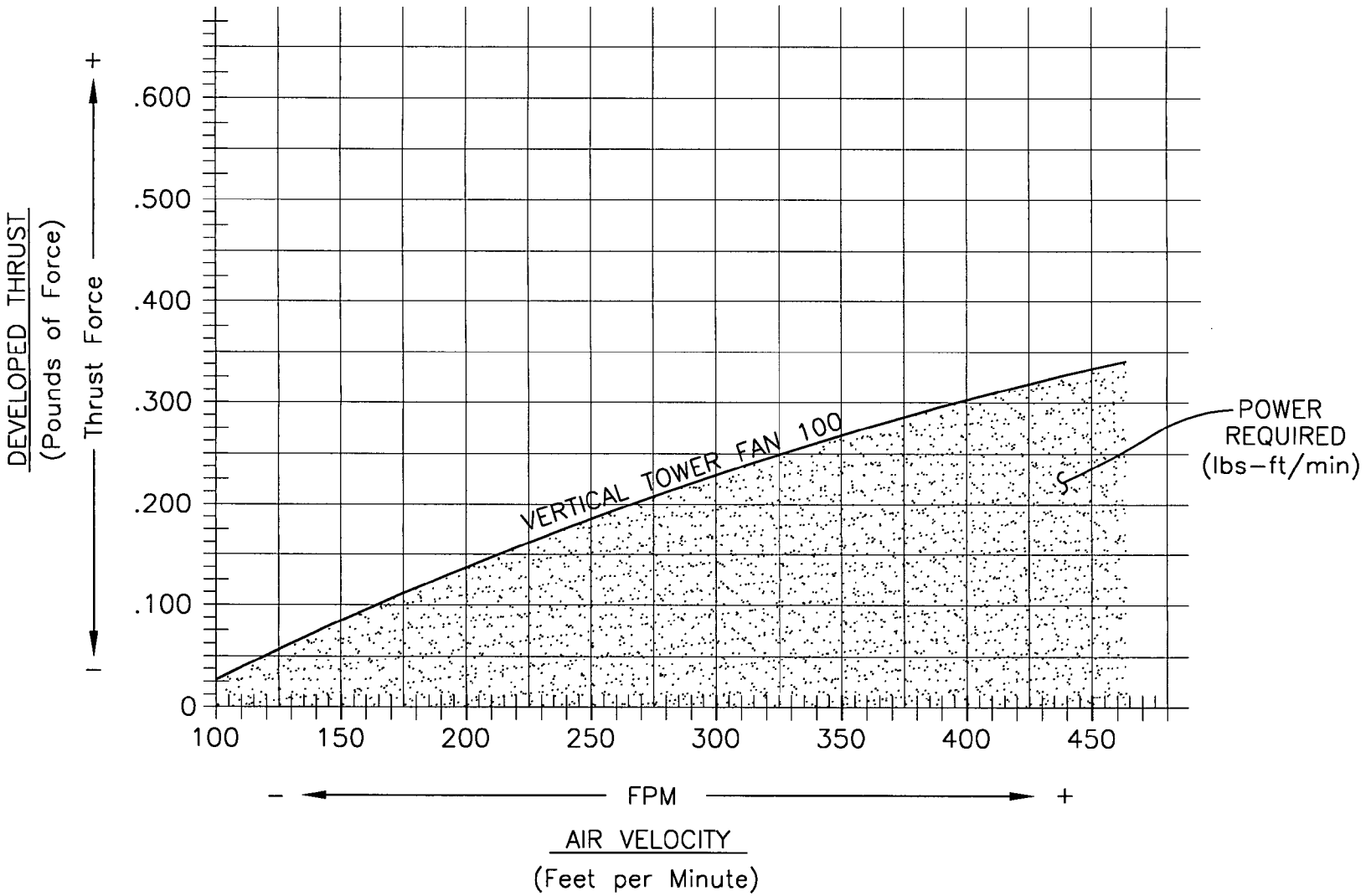

FIGS. 7 and 8 illustrate two graphs that compare the thrust characteristic of a conventional portable fan utilizing an axial impeller and an embodiment of vertical tower fan 100, respectively. FIG. 7 shows air velocity in feet per minute versus the thrust developed in pound for a conventional fan utilizing an axial impeller. The shaded area under the curve is the required power from the motor of a conventional fan utilizing an axial impeller in lbs-ft per minute. The shaded area below the curve is also indicative of the air volume generated by a conventional fan utilizing an axial impeller. FIG. 8 shows air velocity in feet per minute versus the thrust developed in pound for vertical tower fan 100 in accordance with one exemplary embodiment of the present invention. The shaded area under the curve is the required power from the motor of vertical tower fan 100 in lbs-ft per minute. The shaded area below the curve is also indicative of the air volume generated by vertical tower fan 100.

As shown in FIGS. 7 and 8, air impeller 120 of vertical tower fan 100 is designed to optimize the desired characteristics of achieving the air velocity exiting vertical tower fan 100 while minimizing the thrust created. Maintaining the desired velocity maximizes the cooling effect for the user. Minimizing or limiting the thrust reduces it's destabilizing effects on vertical tower fan 100. Thrust is the force that is generated in a direction opposite the flow direction of exhaust air stream 302 it exits housing 102, as shown in FIG. 5. To remain stable and in an upright position, vertical tower fan 100 counteracts this force of thrust. One method of counteracting the force of thrust is to increase the size of base 160 of vertical tower fan 100. Minimizing or limiting the thrust reduces it's the destabilizing effects and in-turn reduces the need for a large base. Reducing the need of a large base facilitates possible space saving characteristics while allowing the vertical aspect ratio of exhaust air stream 302.

Another advantage to the minimization of thrust is that motor 116 of the vertical tower fan 100 does not require the power, (measured in work per minute, e.g. watts) that would be needed to move a large volume of air. This allows the needed motor torque to be reduced and decreases the heat generated by motor 116. Motor 116 may therefore utilize fewer materials and be less expensive while yet producing the required air stream velocity. This in turn yields cost savings for the manufacturer and the consumer. In one embodiment the maximum torque motor 116 is capable of generating is less than about 22 in-oz.

In one exemplary embodiment exhaust air stream 302 has a maximum velocity V of about 400 feet per minute or greater when measured at a distance of about 8 feet from housing 102. The maximum velocity of exhaust air stream 302 is measured by locating an anemometer 8 feet from air outlet 112 of portable air moving device 100. The anemometer is moved vertically up and down and horizontally while maintaining the 8 feet of distance until the maximum velocity within exhaust air stream 302 is located.

In another exemplary embodiment the maximum thrust generated in a direction opposite the direction of the flow of exhaust air stream 302 is about 0.5 lbs or less. The maximum thrust is measured using a certified thrust table as specified by AMCA (Air Movement and Control Association). In another exemplary embodiment the ratio of the velocity V of exhaust air stream 302 when measured at a distance of about 8 feet from housing 102 divided by the maximum thrust generated in a direction opposite the direction of the flow of exhaust air stream 302 is about 800 to 1 or greater.

Figure 10:
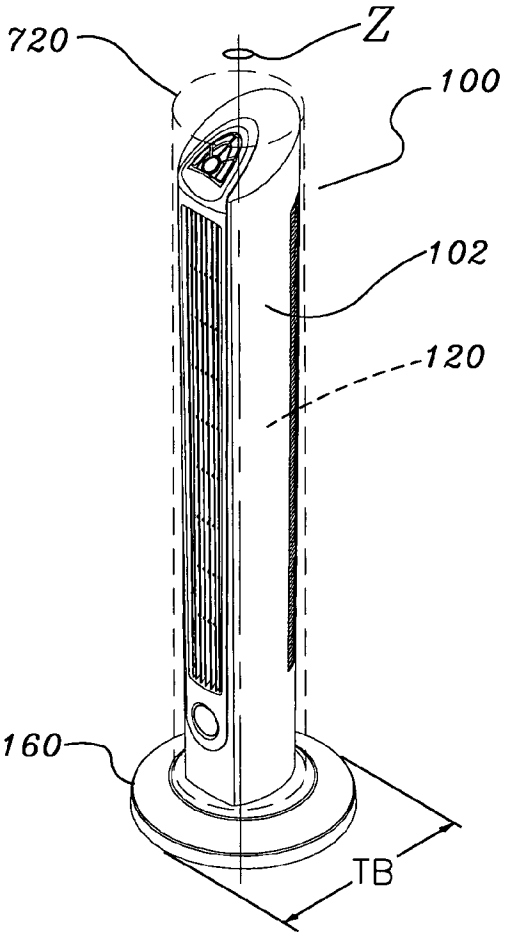
FIGS. 9 and 10 are comparative perspective views of a conventional portable fan utilizing an axial type impeller and an exemplary vertical tower fan in accordance with the present invention.
Figure 9:
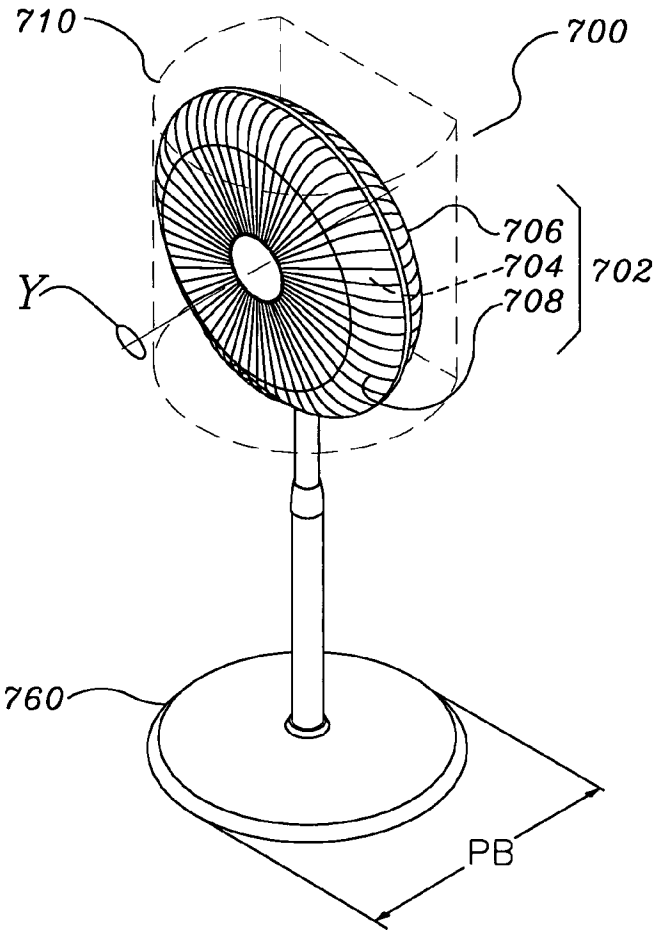
FIG. 9 PRIOR ART

FIGS. 9 and 10 show comparison views of conventional portable fan 700 utilizing fan assembly 702 and vertical tower fan 100, respectively. As shown in FIG. 9, fan assembly 702 includes axial impeller 704 and protective grills 706, 708. In comparison vertical tower fan 100, shown in FIG. 10, has a smaller area of oscillation 720 than area of oscillation 710 of conventional portable fan 700. This is due to the vertical aspect ratio of housing 102 of vertical tower fan 100 when compared to the size of fan assembly 702 of conventional portable fan 700. Area of oscillation 720 of vertical tower fan 100 is defined as the area of movement of housing 102 about a vertical axis of rotation with respect to a mounting surface. The area of oscillation 710 of conventional portable fan 700 is defined as the area of movement of fan assembly 702 about a vertical axis of rotation with respect to a mounting surface.

Axis of rotation Y of axial impeller 704 is oriented horizontally on conventional portable fan 700. In contrast, axis of rotation Z of air impeller 120 of vertical tower fan 100 is oriented vertically. This difference reduces the effects of gyroscopic precession during the oscillation of housing 102 and increases the stability of vertical tower fan 100 when compared to the effects of gyroscopic precession during oscillation of fan assembly 702 of conventional portable fan 700.

The reduced effects of gyroscopic precession during oscillation and the lower thrust characteristics of the vertical tower fan 100, (best shown in FIGS. 7 and 8) allow base 160 of vertical tower fan 100 to have a maximum width dimension TB that may be smaller when compared to the maximum width dimension PB of base 760 of conventional portable fan 700. The smaller maximum width dimension TB of base 160, allows vertical tower fan 100 to have enhanced space saving characteristics when compared to conventional portable fan 700. Also as shown, due to the minimized width dimension TB of base 160, vertical tower fan 100 may be easily transported from place to place within a living space or between various living spaces as desired.

Figure 11:
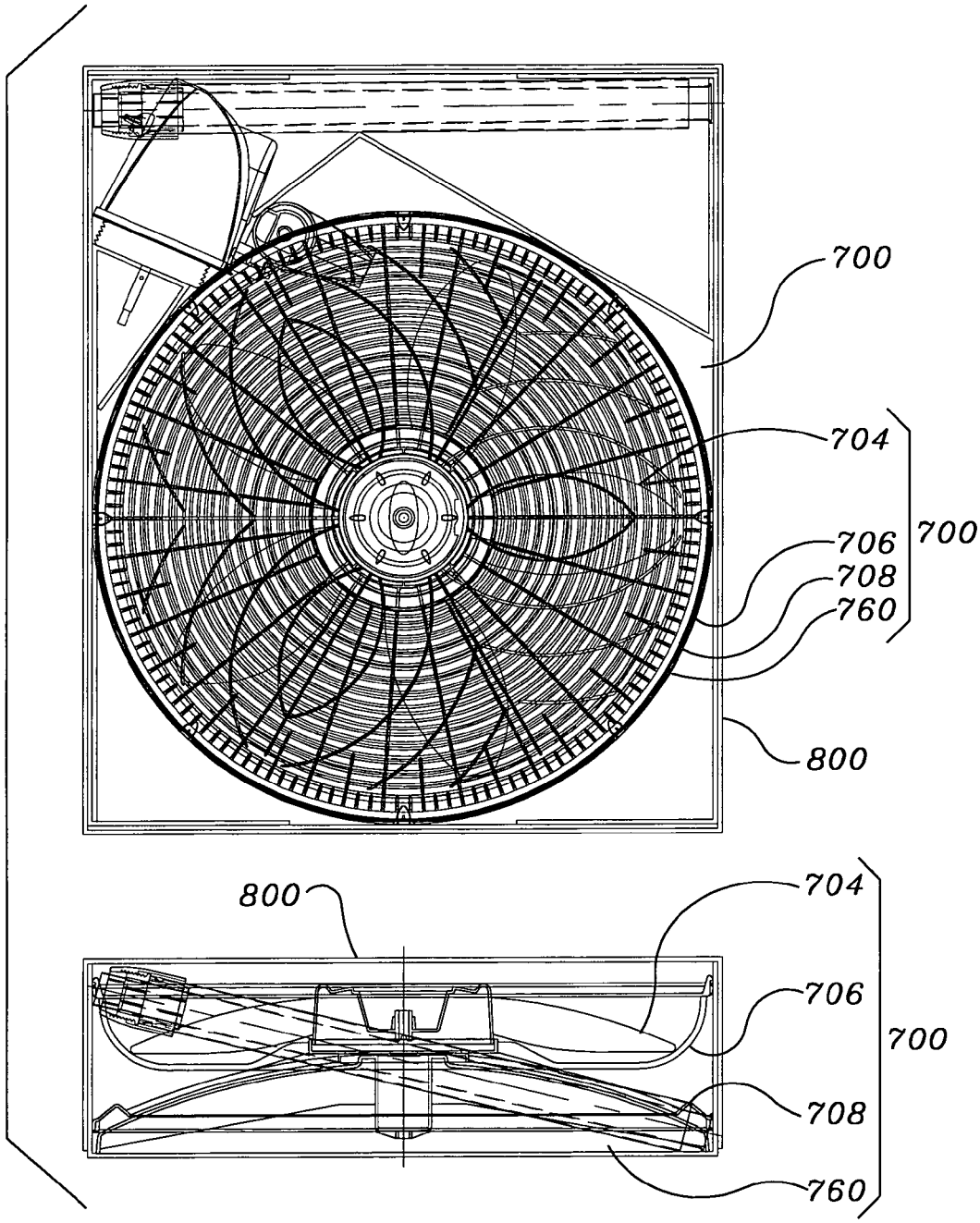
FIG. 11 PRIOR ART
FIGS. 11–13 are views of packaging for a conventional portable fan utilizing an axial impeller.
Figure 12:
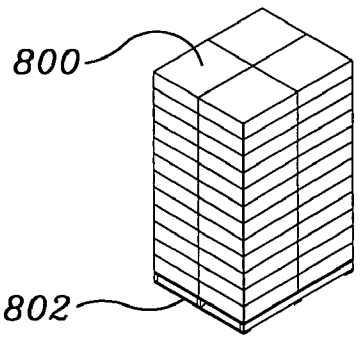
Figure 13:
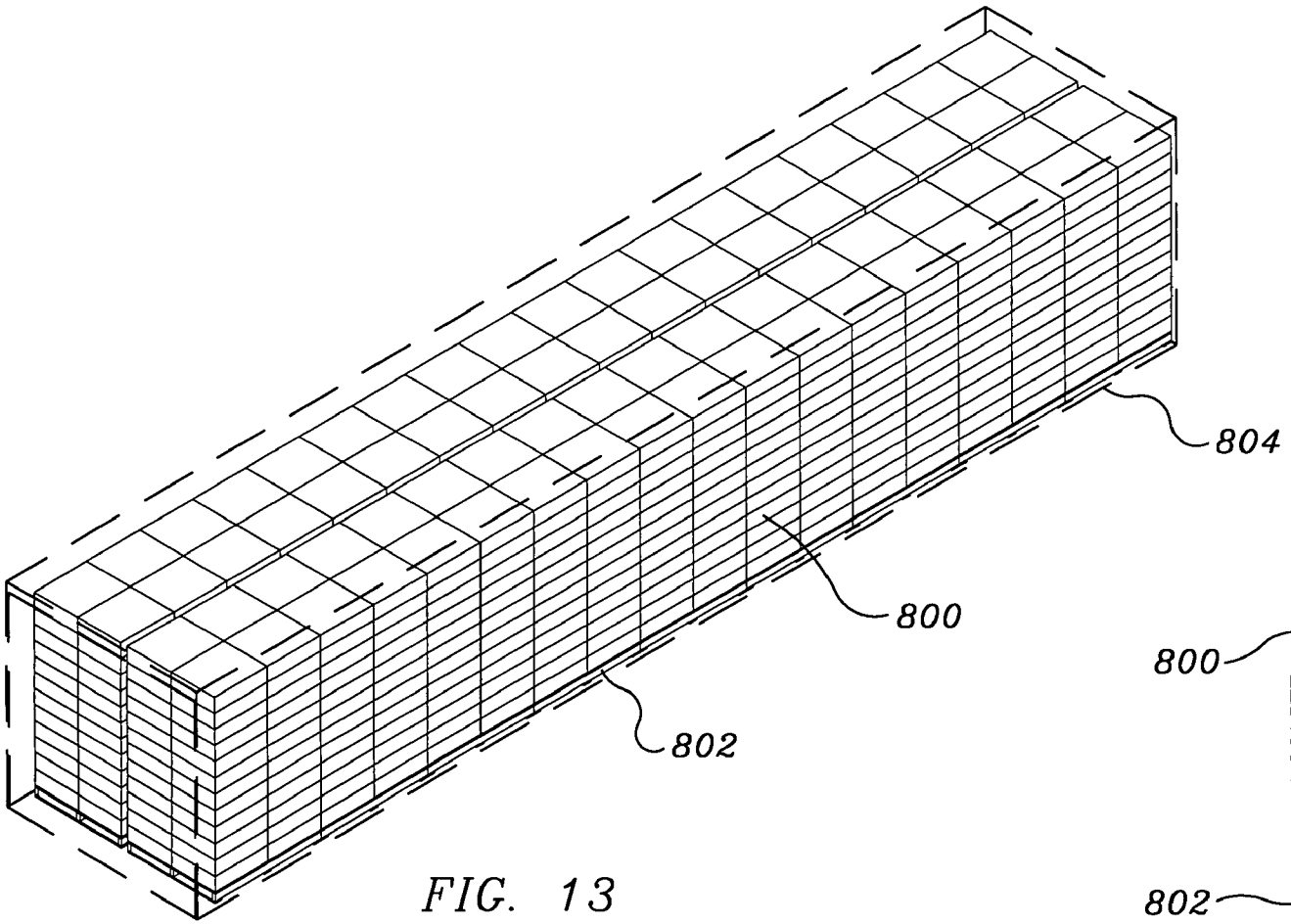
FIG. 13 PRIOR ART

FIGS. 11–13 are views of packaging conventional portable fan 700. Conventional portable fan 700 requires a significant amount of packaging material as well as space for shipment. Typically, shipping box 800 is stacked with many other shipping boxes 800 on pallet 802 (shown in FIG. 12) with multiple pallets 802 shipped together in an overland or over water shipping container 804, (shown in FIG. 13). Due to its large size, the number of conventional portable fans 700 that may be contained within shipping container 804 may be limited.

As shown in FIG. 11, conventional portable fan 700 is shipped to the user in a disassembled form in shipping box 800. The components of conventional portable fan 700 are packed separately in shipping box 800. As shown the packing of blade 704, protective grills 706 and 708, base 760 and other components require the user to assemble conventional portable fan 700.

Figure 14:
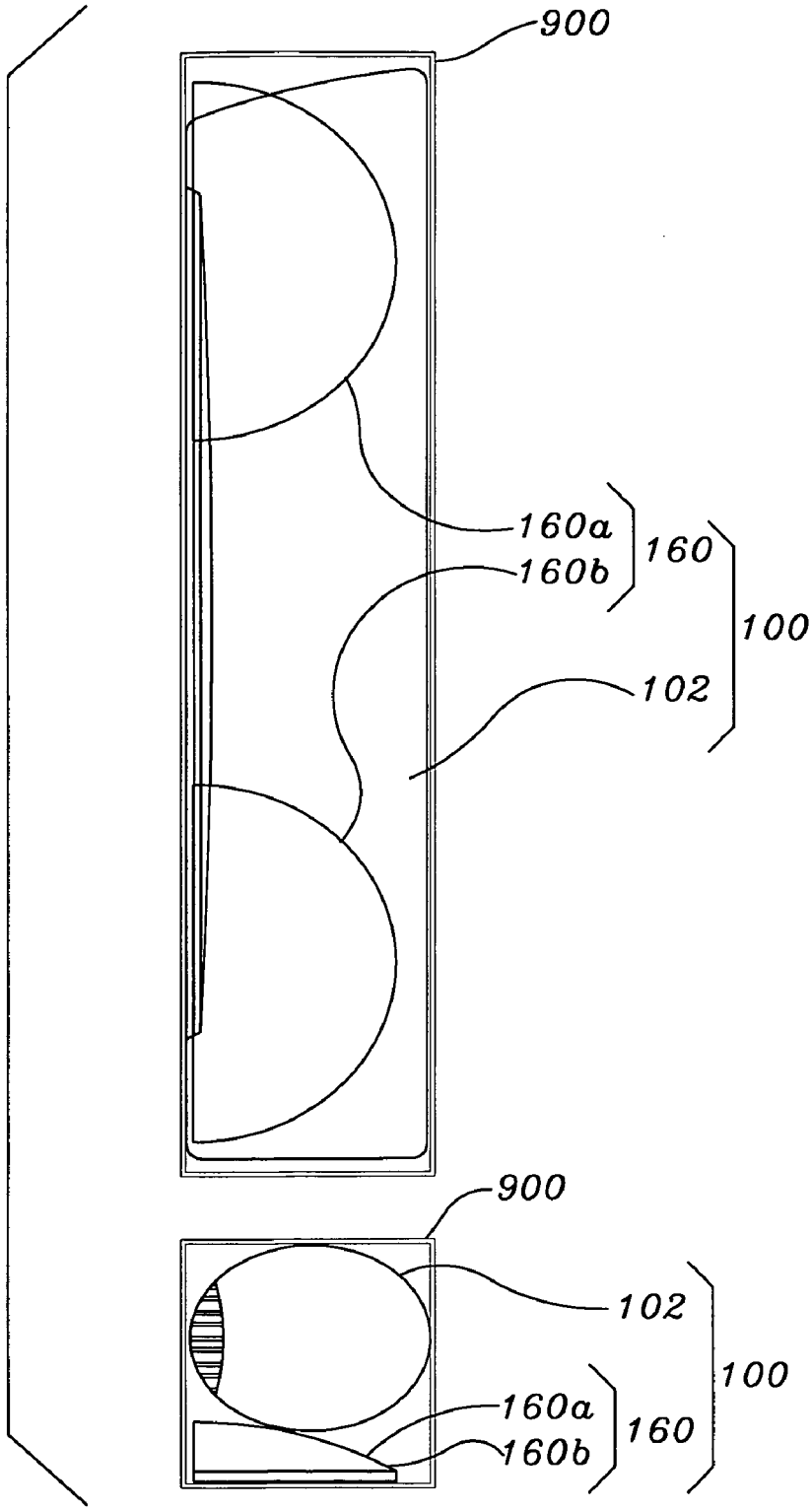
FIGS. 14–16 are views of packaging of the vertical tower fan of the present invention.
Figure 15:
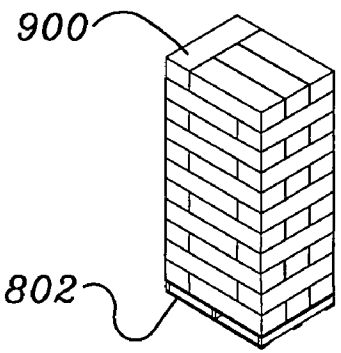
Figure 16:
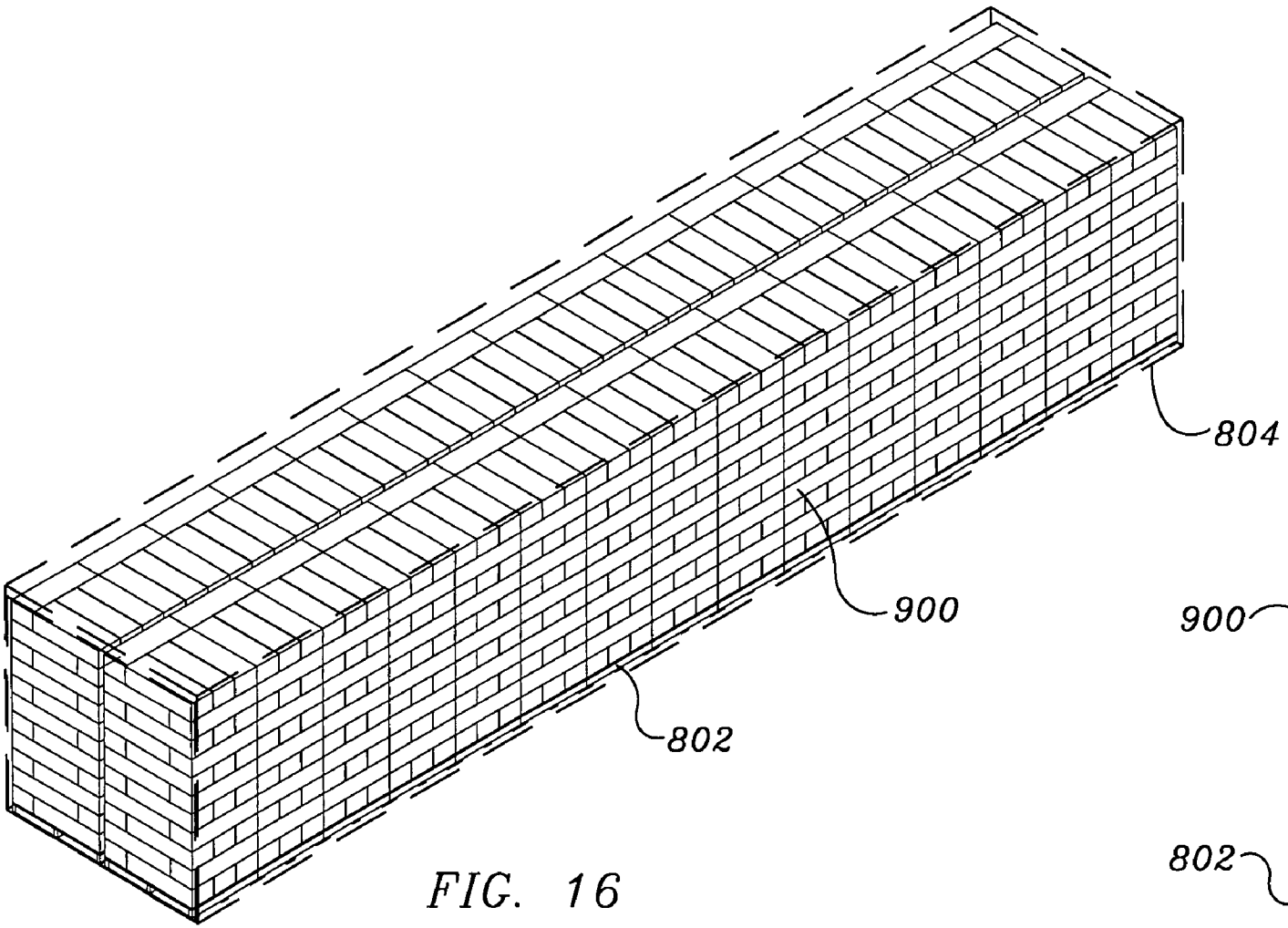

FIGS. 14–16 illustrate advantages realized with respect to packaging and shipment of an exemplary design of the vertical tower fan 100. As shown in FIG. 14, the vertical tower fan 100 is packaged in shipping box 900. Shipping box 900 may be smaller than shipping box 800 (see FIG. 11) of the conventional portable fan 700, thus using less packaging materials and lowering the cost of the packaging.

As shown in FIGS. 15 and 16, when compared to conventional portable fan 700, shipping vertical tower fan 100 of the present invention in container 804 requires less volume. Furthermore, the number of units capable of transportation in shipping container 804 as shown in FIG. 16 increases when compared to shipping conventional portable fan 700 of FIGS. 12 and 13. These shipping advantages yield a lower cost of transportation and a cost advantage for the manufacturer and the consumer.

As shown in FIG. 14, vertical tower fan 100 is shipped to the user in a substantially assembled form in shipping box 900. The only separate components of vertical tower fan 100 within shipping box 900 are housing 102 and base 160. In the illustrated embodiment, base 160 is further disassembled into base portion 160*a* and base portion 160*b*, thus further economizing the required volume of shipping box 900. Shipping vertical tower fan 100 in a substantially assembled form limits the assembly required by the end user and contributes to an enhanced customer experience and may reduce the quantity of units returned to the retailer and manufacturer.

Vertical tower fan 100 as described produces exhaust air stream 302 having a vertical aspect ratio. The vertical aspect ratio of exhaust air stream 302 conforms to the human form without the need to produce large volumes of air. Exhaust air stream 302 has a velocity sufficient to impinge upon the user and accelerate evaporation and therefore the cooling effect for the user. The lower volume of exhaust air stream 302 produced by blower assembly 106 requires less power to produce and also lowers the thrust generated as exhaust air stream 302 exits interior space 104 of housing 102. The lower power requirement reduces the cost of electric motor 116 while the lower thrust increases the stability of vertical tower fan 100 thus reducing required size of base 160. The decreased size of base 160 combined with the elimination of the large protective grills of the prior art minimize the space required to operate, store and ship vertical tower fan 100. The minimization of space significantly enhances the space saving aspects of vertical tower fan 100. The minimization of space also allow vertical tower fan 100 to be shipped with little or no customer assembly requirements which can result in increases customer satisfaction and may decrease returns to the retailer and manufacturer.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A vertical tower fan that is portable and free standing on a support surface, said vertical tower fan comprising:

an air blower assembly comprising;

at least one motor;

at least one air impeller rotated about an axis of rotation by said motor, said axis of rotation being oriented substantially vertically;

an axial length of said air impeller, said axial length of said air impeller being greater than about 24 inches;

a vertically oriented elongate housing having at least one sidewall having a longitudinal length extending substantially upward from said support surface;

an interior space defined by said elongate housing, said air blower assembly being disposed within said interior space;

at least one air inlet in said at least one sidewall allowing intake air to enter said interior space;

an air guide disposed within said interior space;

an exhaust air stream generated by said air blower assembly, wherein said exhaust air stream comprises a maximum velocity in the range of about 150 feet per minute to about 450 feet per minute at a distance of about 8 feet from the vertical tower fan, wherein said exhaust air stream also comprises a maximum exit elevation greater than about 36 inches, said maximum exit elevation defined by a distance from said support surface to a highest exit elevation of said exhaust air stream, and wherein the velocity of said exhaust air stream, the maximum exit elevation of said exhaust air stream, and the axial length of said air impeller enable said exhaust air stream to deliver a desired cooling effect at a predetermined distance from the vertical tower fan;

an elongate air outlet located in said at least one sidewall allowing said exhaust air stream to exit said interior space above said support surface;

an air cut-off disposed within said interior space;

a base of said elongate housing for engaging said support surface; and an overall height of said device being defined as the distance from where said base engages said support surface to a maximum vertical extent of said device, wherein said overall height of said device is greater than about 44 inches.

2. A vertical tower fan that is portable and free standing on a support surface, said vertical tower fan comprising:

a vertically oriented elongate housing having at least one sidewall having a longitudinal length extending substantially upward from a bottom to a top of said elongate housing;

an interior space defined by said elongate housing;

at least one air inlet in said at least one sidewall allowing intake air to enter said interior space;

an elongate air outlet located in said at least one sidewall allowing an exhaust air stream to exit said interior space above said support surface, wherein said exhaust air stream comprises a maximum exit elevation greater than about 36 inches said maximum exit elevation defined by a distance from said support surface to a highest exit elevation of said exhaust air stream;

an air blower assembly disposed within said interior space generating said exhaust air stream, said air blower assembly comprises;

at least one air impeller, said air impeller being a transverse type air impeller;

an axial length of said air impeller extending substantially upward, said length of said transverse air impeller being greater than about 24 inches;

at least one motor for rotating said air impeller about a substantially vertical axis of rotation;

an air guide disposed within said interior space and having a portion extending along said axial length of said air impeller;

an air cut-off disposed within said interior space and having a portion extending along said axial length of said air impeller;

a base coupled to said bottom of said elongate housing for maintaining said elongate housing in a vertical, upright position on said support; and a velocity to thrust ratio of about 800 to 1 or greater, wherein the velocity comprises a maximum measured velocity of said exhaust air stream in feet per minute at about 8 feet from the vertical tower fan and the thrust comprises a maximum measured thrust in pounds of force generated by said exhaust air stream in a direction substantially opposite to a direction of flow of said exhaust air stream, and wherein the velocity to thrust ratio optimizes the performance of the vertical tower fan by minimizing thrust and its destabilizing effect on the vertical tower fan while providing a desired cooling effect at a predetermined distance from the vertical tower fan.

3. The vertical tower fan according to claim 1 or 2, further comprising a vertical aspect ratio of said elongate housing defined by said longitudinal length being greater than a maximum width of said elongate housing, wherein said vertical aspect ratio is greater than about 3 to 1.

4. The vertical tower fan according to claim 1 or 2, further comprising a minimum exit elevation of said exhaust air stream, said minimum exit elevation defined by a distance from said support surface to a lowest vertical exit elevation of said exhaust air stream, wherein said minimum exit elevation is less than about 15 inches.

5. The vertical tower fan according to claim 1 or 2, further comprising a vertical length of said exhaust air stream as it exits said housing, said vertical length of said exhaust air stream being greater than about 24 inches.

6. The vertical tower fan of claim 5 further comprising a vertical aspect ratio of said exhaust air stream as it exits said housing, said vertical aspect ratio being defined as said vertical length of said exhaust air stream being greater than a horizontal width of said exhaust air stream as it exits said housing, wherein said vertical aspect ratio is greater than about 10 to 1.

7. The vertical tower fan of claim 5, further comprising a horizontal width of said exhaust air stream, wherein said horizontal width of said exhaust air stream is less than about 3 inches.

8. The vertical tower fan according to claim 1 or 2, further comprising a maximum diameter of said air impeller, wherein said maximum diameter of said air impeller is less than about 4 inches.

9. The vertical tower fan according to claim 1 or 2, further comprising a maximum diameter of said air impeller, wherein said maximum diameter of said air impeller is within a range between about 2.5 inches and about 3.75 inches.

10. The vertical tower fan according to claim 1 or 2, wherein said air impeller is constructed of fiber-reinforced polymer utilizing a polymer matrix and fibers, filaments and/or fillers.

11. The vertical tower fan according to claim 1 or 2, wherein said air impeller further comprises about six or more sections assembled together.

12. The vertical tower fan of claim 11, wherein the number of sections assembled together is between about 7 sections and about 12 sections.

13. The vertical tower fan of claim 11, wherein an axial length of one of said sections of said air impeller is less than about 5 inches.

14. The vertical tower fan of claim 11, wherein an axial length of one of said sections of said air impeller is between about 2.5 inches and about 4.5 inches.

15. The vertical tower fan according to claim 1 or 2, wherein said motor generates a maximum torque, said maximum torque being less than about 22 in-oz.

16. The vertical tower fan according to claim 1 or 2, wherein an axis of said longitudinal length of said elongate housing is substantially parallel to said axis of rotation of said air impeller of said air blower assembly.

17. The vertical tower fan of claim 16, wherein said elongate housing rotates and/or oscillates about an axis of rotation with respect to said support surface.

18. The vertical tower fan of claim 17, wherein said axis of said rotation of said elongate housing is substantially parallel to said longitudinal length of said elongate housing.

19. The vertical tower fan of claim 16, further comprising a rotator mechanism for moving said elongate housing relative to said support surface.

20. The vertical tower fan of claim 19, wherein said rotator mechanism comprises a rotator for one of continuous, step-wise, and/or oscillatory rotating of said elongate housing.

21. The vertical tower fan of claim 20, further comprising a pre-determined angular range of said rotating of said elongate housing, wherein said pre-determined angular range is between about 0 degrees and about 360 degrees.

22. The vertical tower fan of claim 20, further comprising a pre-determined angular range of said rotating of said elongate housing , wherein said pre-determined angular range is between about 0 degrees and about 90 degrees.

23. The vertical tower fan of claim 20, further comprising a rotatable coupling between said base and said elongate housing, wherein said elongate housing rotates with respect to said base.

24. The vertical tower fan of claim 19, wherein said movement of said elongated housing is a rotational oscillating movement about an axis of rotation, said axis of rotation of said housing being substantially parallel to said axis of rotation of said air impeller.

25. The vertical tower fan of claim 24, wherein a combination of said rotational oscillating movement of said elongate housing being substantially parallel to said axis of rotation of said air impeller reduces the effects of gyroscopic precession during said rotational oscillating movement of said elongate housing and increases the stability of said vertical tower fan.

26. The vertical tower fan of claim 25, wherein said increased stability allows a maximum width of said base to be minimized with respect to a maximum width of said elongate housing resulting in space-savings.

27. The vertical tower fan according to claim 1 or 2, wherein said base is a unitary part of said elongate housing.

28. The vertical tower fan according to claim 1 or 2, wherein said base is rotatably coupled to said elongate housing.

29. The vertical tower fan according to claim 1 or 2, wherein said vertical tower fan is substantially assembled and disposed in a package for shipment.

30. The vertical tower fan according to claim 1 or 2, wherein said base is detachably coupled to said elongate housing having an operating configuration in which said base is coupled to said elongate housing and a non-operating configuration in which said base is detached from said elongate housing.

31. The vertical tower fan of claim 30, wherein said non-operating configuration of said vertical tower fan is disposed in a package for shipment.

32. The vertical tower fan of claim 30, wherein said base further comprises a split base having at least a first portion and a second portion that can be separated in said non-operating configuration.

33. The vertical tower fan according to claim 1 or 2, wherein said air impeller is located substantially above said at least one motor with respect to said base.

34. The vertical tower fan of claim 33, further comprising an upper impeller bearing assembly wherein said upper impeller bearing assembly supports a shaft of said air impeller as said air impeller rotates about said axis of rotation.

35. The vertical tower fan of claim 33, wherein said upper impeller bearing assembly further comprises a spherical bearing, an oil cup, capillary media located inside said oil cup, a slinger and oil, wherein said oil slinger rotates with said shaft of said air impeller.

36. The vertical tower fan of claim 35, wherein said capillary media physically contacts said spherical bearing and substantially covers an inside circumferential area of said oil cup.

37. The vertical tower fan of claim 36, wherein said oil cup extends substantially below said spherical bearing toward said support surface allowing said capillary media to return said oil to said bearing after said oil migrates along said shaft of said impeller toward said oil slinger.

38. The vertical tower fan of claim 37, wherein said spherical bearing is constructed of porous material.

39. The vertical tower fan according to claim 1 or 2, further comprising a handle, wherein said handle is part of said elongate housing.

40. The vertical tower fan according to claim 1 or 2, further comprising a power cord, electrical components and electrical component connections wherein the electrical component connections are integrated within said elongate housing.

41. The vertical tower fan according to claim 1 or 2, further comprising a control assembly for controlling a function of said vertical tower fan.

42. The vertical tower fan of claim 41, wherein said control assembly is one of attached to said elongate housing and/or a remote device.

43. The vertical tower fan of claim 41, wherein said at least one motor further comprises a variable speed motor having one or more rotational speeds, and said control.

44. The vertical tower fan of claim 41, wherein said control assembly is substantially sealed and substantially weather proof.

45. The vertical tower fan according to claim 1 or 2, wherein said at least one motor is a totally enclosed non-ventilated electric motor.

46. The vertical tower fan according to claim 1 or 2, further comprising a rain sensor for controlling a function of said vertical tower fan.

47. The vertical tower fan of claim 1, wherein said at least one air impeller is a transverse type air impeller.

48. The vertical tower fan of claim 1, wherein said air guide further comprises a concave form when referenced from said axis of rotation of said air impeller; and wherein said air cut-off further comprises a convex form when referenced from said axis of rotation of said air impeller.

49. The vertical tower fan of claim 1, wherein at least one of said air guide and/or said air cut-off is integral to said elongate housing.

50. The vertical tower fan of claim 1, wherein said interior space further comprises:

an intake portion in fluid communication with said at least one air inlet and defined by portions of said elongate housing, said air guide, said air cut-off, and said air impeller;

an exhaust portion in fluid communication with said elongate air outlet and defined by portions of said air guide, said air cut-off, and said air impeller.

51. The vertical tower fan of claim 1, wherein said air impeller further comprises an intake side defined by a first distance as measured in a direction of rotation of said air impeller along a circumference of said air impeller between said air cut-off and said air guide.

52. The vertical tower fan of claim 1, wherein said air impeller further comprises an exhaust side defined by a second distance as measured in a direction of rotation of said air impeller along a circumference of said air impeller between said air guide and said air cut-off.

53. The vertical tower fan of claim 1, further comprising a maximum thrust in a direction substantially opposite to a direction of the flow of said exhaust air stream as said exhaust air stream exits said air outlet, wherein said maximum thrust is about 0.5 pound of force or less.

54. The vertical tower fan of claim 1, further comprising a velocity to thrust ratio, wherein said maximum velocity said exhaust air stream compared to a maximum thrust (pounds of force) generated by said exhaust air stream in a direction substantially opposite to the direction of the flow of said exhaust air stream as it exits said air outlet is about 800 to 1 or greater.

55. The vertical tower fan of claim 1, wherein said motor further comprises a multiple speed motor and said range of said maximum velocity is applicable to at least one of said multiple speeds.

56. The vertical tower fan of claim 2, further comprising an overall height of said vertical tower fan being defined as the distance from said base to a maximum vertical extent of said vertical tower fan, wherein said overall height is greater than about 44 inches.

57. The vertical tower fan of claim 2, further comprising a maximum velocity of said exhaust air stream measured about 8 feet from said air outlet wherein maximum velocity is about 400 feet per minute or greater.

58. The vertical tower fan of claim 2, wherein at least one of said air guide and/or said air cut-off is integral to said elongate housing.

59. The vertical tower fan of claim 2, wherein said interior space further comprises:

an intake portion in fluid communication with said at least one air inlet and defined by portions of said elongate housing, said air guide, said air cut-off, and said air impeller;

an exhaust portion in fluid communication with said elongate air outlet and defined by portions of said air guide, said air cut-off, and said air impeller.

60. The vertical tower fan of claim 2, wherein said air impeller further comprises an intake side defined by a first distance as measured in a direction of rotation of said air impeller along a circumference of said air impeller between said air cut-off and said air guide.

61. The vertical tower fan of claim 2, wherein said air impeller further comprises an exhaust side defined by a second distance as measured in a direction of rotation of said air impeller along a circumference of said air impeller between said air guide and said air cut-off.

62. The vertical tower fan of claim 2, wherein said air guide further comprises a concave form when referenced from said axis of rotation of said air impeller; and wherein said air cut-off further comprises a convex form when referenced from said axis of rotation of said air impeller.

63. A vertical tower fan that is portable and free standing on a support surface, said vertical tower fan comprising:

an air blower assembly comprising;

a motor having an output shaft;

an air impeller having an axial length greater than about 24 inches, wherein said air impeller is coupled to said output shaft and located above said motor and rotated about an axis of rotation by said motor, said axis of rotation being oriented substantially vertically;

an impeller shaft extending from an end of said air impeller opposite said motor;

an upper impeller bearing assembly that supports said impeller shaft as said air impeller rotates about said axis of rotation;

a vertically oriented elongate housing having at least one sidewall having a longitudinal length extending substantially upward from said support surface;

an interior space defined by said elongate housing, said air blower assembly being disposed within said interior space;

at least one air inlet in said at least one sidewall allowing intake air to enter said interior space;

an exhaust air stream generated by said air blower assembly, a maximum exit elevation of said exhaust air stream being greater than about 36 inches, said maximum exit elevation defined by a distance from said support surface to a a maximum thrust of said exhaust air stream being about 0.5 pounds of force or less in a direction substantially opposite to a direction of flow of said exhaust air stream, wherein the maximum thrust minimizes destabilizing effects of said exhaust air stream on the vertical tower fan;

an elongate air outlet located in said at least one sidewall allowing said exhaust air stream to exit said interior space above said support surface; and a base of said elongate housing for engaging said support surface.

64. The vertical tower fan of claim 63, further comprising a minimum exit elevation of said exhaust air stream, said minimum exit elevation defined by a distance from said support surface to a lowest vertical exit elevation of said exhaust air stream, wherein said minimum exit elevation is less than 15 inches.

65. The vertical tower fan of claim 63, further comprising a maximum velocity of said exhaust air stream measured about 8 feet from said air outlet, wherein said maximum velocity is about 400 feet per minute or greater.

66. The vertical tower fan of claim 63, wherein said motor generates a maximum torque of less than about 22 in-oz.

* * * * *